United States Patent [19]

Seragnoli

[11] 3,987,753

[45] Oct. 26, 1976

[54] DEVICE FOR DEPOSITING CONTROLLED AMOUNTS OF ADHESIVE SUBSTANCES

[75] Inventor: Enzo Seragnoli, Bologna, Italy

[73] Assignee: G. D Societa Per Azioni, Italy

[22] Filed: July 2, 1974

[21] Appl. No.: 485,130

[30] Foreign Application Priority Data

Sept. 21, 1973 Italy ..... 3499/73

[52] U.S. Cl. ..... 118/212; 118/221; 118/262

[51] Int. Cl.[2] ..... B05C 1/02

[58] Field of Search ..... 118/212, 221, 225, 255, 118/262, 227

[56] References Cited

UNITED STATES PATENTS

| | | | |
|---|---|---|---|
| 398,135 | 2/1889 | Dreyfuss | 118/262 X |
| 474,572 | 5/1892 | Brock | 118/262 X |
| 634,805 | 10/1899 | Craw | 118/221 |
| 1,549,576 | 8/1925 | La Bombard et al. | 118/262 |
| 1,729,811 | 10/1929 | Anderson | 118/221 X |
| 1,928,160 | 9/1933 | Watkins et al. | 118/262 X |
| 2,276,997 | 3/1942 | Richardson | 118/221 X |
| 2,767,683 | 10/1956 | Foley | 118/262 X |
| 3,162,546 | 12/1964 | Jefferys | 118/227 X |

*Primary Examiner*—John P. McIntosh
*Attorney, Agent, or Firm*—Robert E. Burns; Emmanuel J. Lobato; Bruce L. Adams

[57] ABSTRACT

A device for depositing an adhesive substance at one or more predetermined points on wrapping material comprises rotating transfer or applicator disks with irregular profiles including areas destined for transferring the adhesive substance from a tank directly to a corresponding number of predetermined points on the wrapping material. A pair of wiper disks wipe adhesive substance from the two sides of each transfer disk ahead of the position where the adhesive substance is deposited. A dosing collar is interposed between every two wiper disks for dosing and rendering uniform in thickness the adhesive substance on the areas destined to transfer the adhesive substance. The wiper disks and dosing collars are given, in the interaction area with the transfer disks, a movement in a direction opposite to that of the transfer disks.

6 Claims, 5 Drawing Figures

DEVICE FOR DEPOSITING CONTROLLED AMOUNTS OF ADHESIVE SUBSTANCES

BACKGROUND OF THE INVENTION

This invention relates to devices for depositing an adhesive substance or glue at one or more predetermined points on wrapping material, particularly on sheets or cuttings for wrapping products of prismatic shape, such as packets of cigarettes and other similar articles on automatic wrapping machines.

DESCRIPTION OF THE PRIOR ART

As is known, on automatic machines for wrapping products of prismatic shape, such as, for example, packets of cigarettes and other similar articles, the sheets or cuttings of wrapping material supplied individually in rapid succession to the individual articles to be wrapped at a wrapping station on the wrapping machine are provided by devices known as gluers, along the path taken to arrive at the said wrapping station, with adhesive material along at least one side, at one or more predetermined points, in order that once the wraps have been completed they can be sealed down.

In practice it has been seen that to wrap a product in a way fully complying with the various requirements met in actual practice subsequently to the formation of the wrap, not only must the sealing flaps, that is to say, the flaps which normally determine the stability of the conformation of the wrap, be sealed down perfectly but they must be attached to the underneath surface of the wrapping material and be placed so that their edges extend fully along it, that is to say, the border area of the sealing flaps must be attached to and not be away from the said underneath surface.

To achieve a wrap structured in this particular way, the glue must be spread along the corresponding side/s of the sheet or cutting of wrapping material at a distance from the edge/s in question such that it is kept within the boundaries of the sheet yet, at the same time, does not allow the final extremity of the said edges to be away from the underneath surface of the wrapping material. In the case of the aforementioned products, the said distance is around one millimeter or even less. When the sealing flaps are long and always in the case of the said products, the glue should be distributed at one or more points roughly 3 millimeters high, arranged parallel to the side in question, such as is shown for example on FIG. 1 in the drawings attached hereto, wherein a sheet or cutting 1 of wrapping material is provided with the areas 2 and 2*a* which represent the ideal gluing points with which to form the outer wrap of a packet 3 of cigarettes of what is known as the "American" type, depicted by way of an example in FIG. 2 on the drawings attached hereto.

As is known the adhesive substance or glue is contained in a tank. The task of transferring the glue on to the wrapping material used to be performed by one single device consisting of a rotating member floating in the tank, whilst a second fixed member, called a scraper, adjustable with respect to the rotating member, determined the thickness of the glue to be transferred.

The system as outlined above manifested its limitations, however, when with technological improvements wrapping machines began to operate at a higher speed thereby imposing a considerable increase on the angular velocity of the rotating member. As a consequence of this there was a possibility of the glue splashing and, furthermore, the deposits of glue on the sheets or cuttings proved to be unsatisfactory; indeed an increase in the speed of a device of this particular nature resulted in the adhesive substance not being deposited at uniform points on the surface of the wrapping material.

In order to overcome the aforementioned difficulties, it was decided to use, in conjunction with the said rotating member, a drum or pad floating in the tank, arranged on an axis parallel to that of the rotating member and counter-rotating with respect thereto, so that the said rotating member removed the adhesive substance from the surface of the said drum and transferred it on to the wrapping material.

A device of this type is described, for example, in Italian Pat. No. 803,351 in the name of the assignees hereof, in which the rotating member is provided with one or more blades which extend radially in such a way as to engage, in the course of one rotation, firstly with the cylindrical surface of the counter-rotating drum coated with a film of glue and then with the surface of each sheet or cutting which is thus provided with glue right at the very points chosen for the wrap to be sealed perfectly.

Even with devices of this type sources of trouble were found, however, when using them in conjunction with cigarette packeting machines operating at high speeds, such as, for example, the one described in Italian Pat. No. 803,352 in the name of the assignees hereof.

With the said devices, above all at high rotation speeds, it was, in fact, seen that particles of the adhesive substance accumulate on the rear edges, with respect to the movement direction, of the areas on the rotating member destined to transfer the glue, at the time the said areas move away from the surface of the counter rotating drum.

The result of this is that there is a progressive increase in the glued points which can thus extend until they reach or go past the edges of the sheets or cuttings thereby seriously prejudicing the satisfactory outcome of the subsequent wrapping operations.

Because of glue being outside the proper limits, it can happen that the sheets or cuttings supplied in continuous rapid succession stick to one another and consequently cause a blockage in the line supplying the wrapping material, which necessitates the whole machine being halted and material being wasted.

It is easier to understand the foregoing from the diagram provided by way of an example in FIG. 3, wherein at 4 there is a counter-rotating drum, at 5 a rotating member for transferring the adhesive substance to the wrapping sheet (not shown) by means of the surfaces 5*a*–6*a* of the radial blades 5*b*–6*b* and at 7 a point where particles of adhesive substance continually accumulate, thereby increasing the transfer surfaces 5*a*–6*a*.

As it was noticed that the rotatory movement in opposite directions of the two movable units was, along with the high viscosity of the adhesive substances used, one of the causes for the said phenomenon occurring, there has been designed, according to Italian Pat. No. 834,014 of the assignees hereof, a gluing device in which the said units rotate in the same direction and insofar as the solving of this particular problem is concerned, the results obtained were brilliant.

This method also envisaged the customary fixed plate or scraper placed on edge with respect to the surface of the counter-rotating drum and suitably adjustable so that it can be suited to regulate the thickness of the coating of glue on the surface of the said drum in accordance with requirements.

The gluing devices mentioned first, which are provided with one single rotating transfer member, possess, however, a particularly advantageous characteristic compared with the devices mentioned subsequently thereto and this is due to the fact that the adhesive substance is transferred to the wrapping material by a member floating in the tank in which the glue is held.

A characteristic of this particular nature on the part of glueing devices provided with one single rotating member is especially advantageous also in the event of the wrapping machine being subjected to waiting periods due to interruptions in the supply of the wrapping material. In such cases the usual practice is to keep the gluing device in operation, after it has been moved away from the wrapping material supply line in order to prevent the said line, in the absence of the paper, from being dirtied with glue or, alternatively, to stop the operation of the said device.

With both systems what happens is that in the areas where the glue is picked up and transferred by the rotating member crusts form through the glue drying and this causes the trouble to which reference has been previously made, above all an increase in the surface of the said areas.

It is, therefore, obvious that the almost continuous presence with the liquid of one single movable mamber prevents the glue from drying and forming a crust on the said rotating transfer member as it continues to turn without depositing any glue and that, following a waiting period in which it is immobile, any crust that has formed is easily broken up once the device starts to operate again.

Added to the foregoing are the advantages connected with a more simple and cheaper structure compared with devices in which there are two transfer members.

In the known technique, on account of the reasons given above, the old system of directly transferring the adhesive substance from the tank to the wrapping material by means of one single rotating member has been applied.

According to a well known method the rotating member constituted by a plurality of coaxial disks operates in conjunction with scrapers which are able to automatically adopt two different operating positions, that is to say, a first position for the complete front and lateral scraping of the glue from the said disks and a second position, away from the profile of the said disks, at a point corresponding to the areas destined for the transfer of the glue and for depositing it on to the wrapping material.

SUMMARY OF THE INVENTION

The object of the present invention is, therefore, to make available a gluing device which is able to overcome all the above described difficulties and is also able to combine with the advantageous characteristics of the first gluing devices with one single rotating member, an operating potential to suit the most recent types of wrapping machines which run at a very high speed.

The invention uses rotating means consisting of one or more transfer disks with irregular profiles, including areas with a larger radial extension, destined for transferring adhesive substance from a tank directly to a corresponding number of predetermined points on the wrapping material travelling above the tank. It provides, a pair of wiper disks for wiping adhesive substance from the two sides of each transfer disk ahead of the position where the adhesive substance is deposited, and a doser for dosing and rendering uniform in thickness the adhesive substance on the areas of each transfer disk with a larger radial extension, the wipers and dosers being given, in the interaction area with the transfer disks, a movement counter to that of the transfer disks.

BRIEF DESCRIPTION OF THE DRAWINGS

Further characteristics and advantages will emerge more clearly from the following detailed description of a preferred but not the sole form of embodiment for the device according to the invention, illustrated purely as an unlimited example on the accompanying drawings in which.

DESCRIPTION OF THE PREFERRED EMBODIMENT

Figure 1:
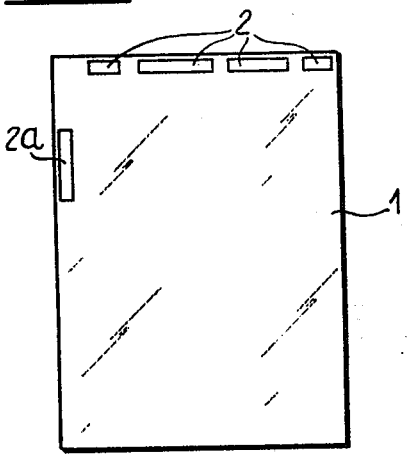
FIGS. 1, 2 and 3 show a sheet of wrapping paper on which the ideal points for depositing the adhesive substance are indicated, a perspective view of a packet of cigarettes wrapped in the sheet shown in FIG. 1 and a diagrammatic lateral view of the operating principle for a known gluing device, respectively.
Figure 2:
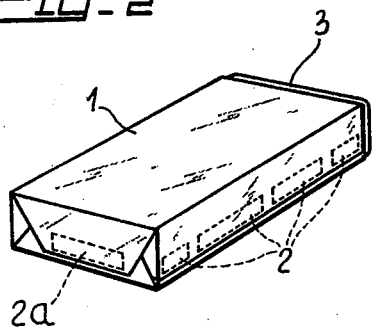
Figure 3:
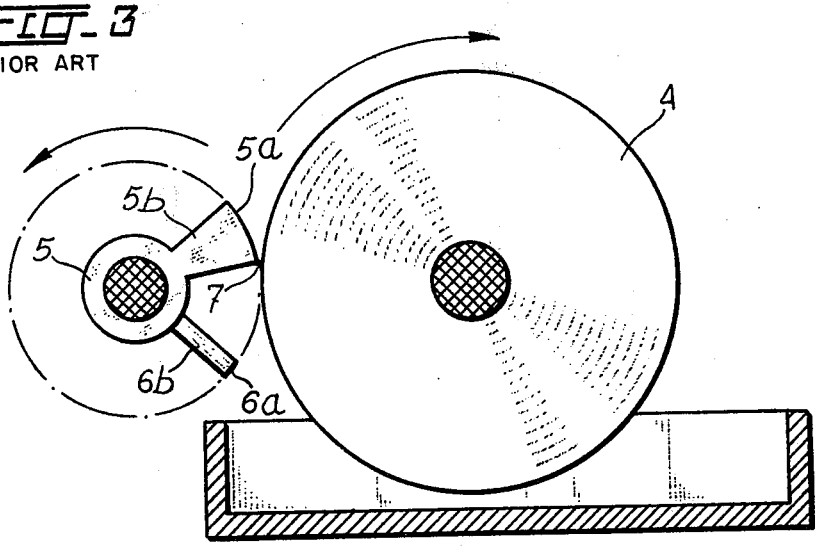
FIG. 3 PRIOR ART

As stated above, FIG. 1 shows a sheet or cutting of wrapping material 1 destined to wrap a packet 3 of cigarettes in the way illustrated in FIG. 2, whilst FIG. 3 shows, in diagrammatic form, a known gluing device for depositing the adhesive substance on the said sheet of wrapping material 1.

The adhesive substance must be deposited on each of the sheets of wrapping material 1 in the areas 2 and 2*a*. As noted above these areas typically are just one millimeter from the sheet edges, and have dimensions of only three millimeters. The adhesive substance should be applied rapidly but accurately to these small, predetermined areas. To obtain a perfect sealing of the packet 3, this should be done for long periods of continuous operation on the part of the gluing device and without any of the problems derived from the use of gluing devices which operate in accordance with the known principles described earlier on, being raised.

Figure 4:
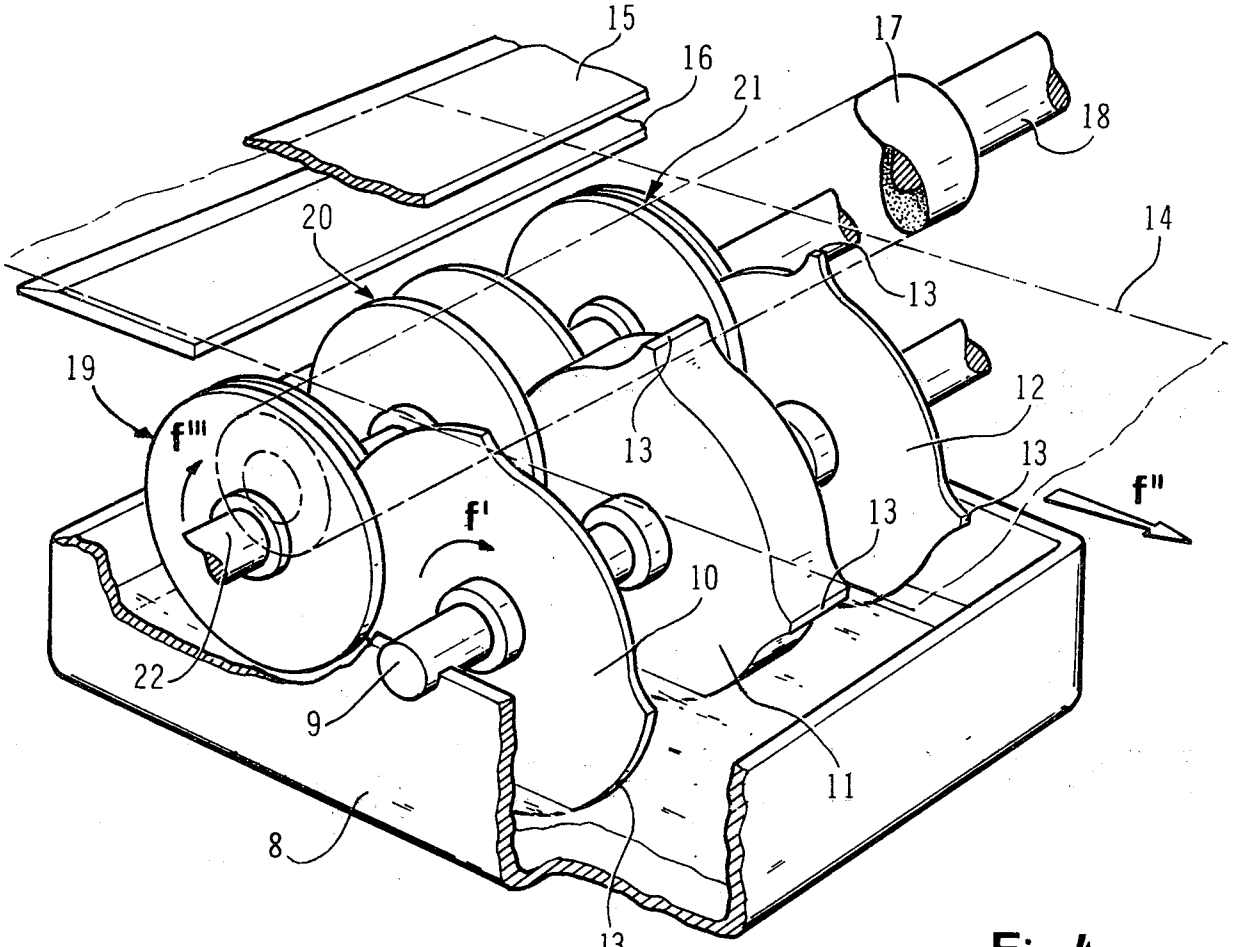
FIG. 4 shows a perspective view of the gluing device according to the invention.
Figure 5:
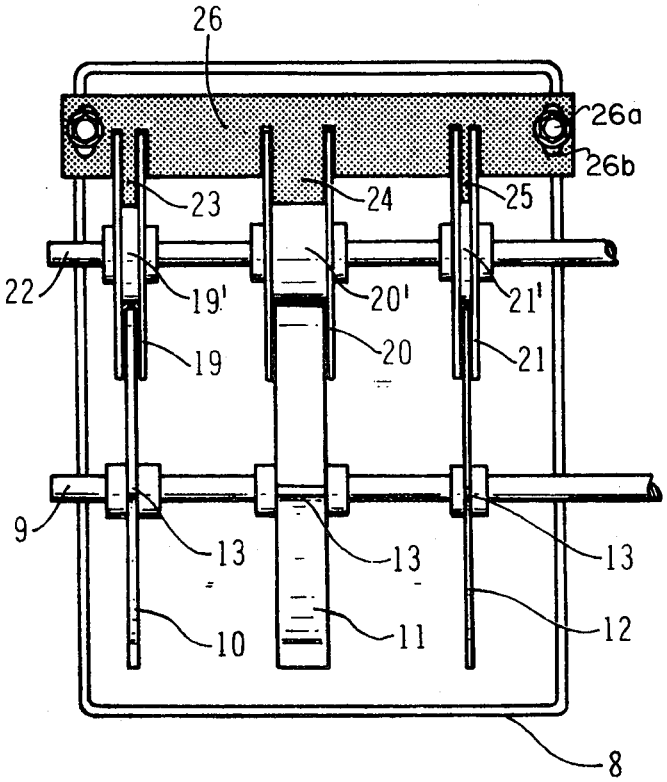
FIG. 5 shows, in plan view form, the same device as in FIG. 4.

According to the invention, as shown in FIGS. 4 and 5, at 8 there is a rectangular tank containing the liquid adhesive substance. At two opposite edges of the tank 8, a horizontal spindle 9 rotating in the direction of the arrow *f'* is supported and this is driven in a way not shown in the said FIGS. 4 and 5.

The spindle 9 has keyed on to it three transfer disks 10, 11 and 12, the lower part of which is immersed in the said tank 8. These disks have an irregular profile which includes areas 13 of a larger radial extension, used to transfer the glue to sheets of wrapping material 14 that slide between surfaces of guides 15 and 16 along a horizontal plane in a direction perpendicular to the spindle 9 (see the arrow *f''*).

A counter-roller 17 is supported by a spindle 18 above the disks 10, 11, 12, to act as a constrast or back-up member for the sheets of wrapping material at the time they are being glued by the abovementioned areas 13. Upstream of the spindle 9 with respect to the direction in which the wrapping material is infed, but below the counter-roller 17, and 12 works in conjunction with a pair of disks 5 which will be known as wipers and numbered 19, 20 and 21, respectively. The pairs of wiper disks are keyed on to a spindle 22 parallel with the spindle 9 and are supported, rotating in the direction of the arrow *f'''*, that is to say, in the same direction as the spindle 9 (arrow *f'*), from two opposite edges of the tank 8 in a way not illustrated in the FIGS. 4 and 5.

Each gluing disk 10, 11, 12 has a certain planar extension parallel to and inserted between planar two disks of the corresponding pair of wipers since the disks belonging to ech pair 19, 20 and 21 are spaced away from each other by dosing collars 19', 20' and 21' whose axial dimensions are in the order of the gauge of the disks 10, 11 and 12.

The two sides of each gluing disk fit closely between the inner surfaces of each corresponding pair of wiper disks so that, once the former revolve out of the tank 8, they are scraped by the latter and all excess glue is removed therefrom.

While the gluing disks are rotating, the areas 13 used to transfer glue on to the wrapping material are not subjected to any scraping action, particularly not on the part of the dosing collars 19', 20' and 21'. The function of the dosing collars is, by suitably dimensioning them, in a radial direction, and/or by regulating the distance between the two spindles 9 and 22, to determine and render uniform in thickness the adhesive substance transferred by the above mentioned transfer areas 13 and to eliminate any excess thereof from these areas.

Between the wiper disks of each pair 19, 20, and 21 there is a fixed scraper plate 23, 24 and 25, respectively. This plate is in with the corresponding doser collar 19', 20' or 21', at a location remote from the area of contact between the doser collar and the gluing disc 10,11,12. The fixed scraper plates 23, 24 and 25 are supported by a member 26 which is itself carried in any known way, for example by bolts 26*a* extending through slots 26b, from one of the lateral walls of the tank 8 so that the plates can be radially adjusted with respect to the corresponding doser collar.

What is claimed is:

1. Apparatus for rapidly and accurately transferring adhesive liquid to small predetermined areas on wrapping sheets, comprising:

a. an upwardly open tank receptive of a body of adhesive liquid and having means disposed above the body of liquid for guiding successive flexible sheets of wrapping material moving rapidly in a straight-lined direction in an elevated plane above the body of liquid to receive transferred adhesive liquid accurately on a small, predetermined area disposed on an underside surface of each moving sheet;

b. a rotatable transfer disk vertically disposed in the tank, normally partly immersed in the liquid, and having a profile portion radially outwardly extending to a small projecting edge portion of the disk for raising adhesive liquid on the small projecting edge portion to a position in said plane, at the top of the disk, to transfer the raised liquid toward registry with the small, predetermined area on each moving sheet, the disk having means for rotating it rapidly to move the small projecting edge portion along the elevated plane, with the moving sheet, in said position;

c. a dosing, wiping and scraping unit disposed in the tank between the liquid body and the elevated plane and comprising a dosing cylinder, wiper disks coaxial therewith, and a stationary scraper disposed in edgewise contact with the dosing cylinder and wiper disks for scraping adhesive liquid therefrom, the dosing cylinder being radially spaced a small distance from the transfer disk for controlling the thickness of the raised adhesive liquid by displacing portions thereof from the small projecting edge portion to sides of the profile portion adjacent thereto, and each wiper disk being coaxial with the dosing cylinder and movably disposed for surface contact of a side thereof with the respective profile portion adjacent to the projecting edge portion substantially throughout consecutive radii of said side, for wiping substantially all the displaced adhesive liquid from said profile portion back into the body of liquid, means for rotating the dosing cylinder and the wiper disks to effect such displacing and wiping; and d. back-up roller means disposed above the elevated plane opposite said position for rotary surface movement along with the moving flexible sheets of wrapping material to accurately guide the small predetermined area, disposed on the underside of each sheet, in said plane to keep said area in registry with the small projecting edge portion of the disk moving along said plane in said position.

2. Apparatus according to claim 1 in which the small projecting edge portion of the transfer disk is point-like to transfer adhesive liquid to a corresponding point-like area on each wrapping head.

3. Apparatus according to claim 1 in which the small projecting edge portion of the transfer disk approximately defines a line transverse of the disk, to transfer adhesive liquid to a corresponding line-like area on each wrapping sheet, transverse of the direction in which the sheet moves.

4. Apparatus according to claim 1 in which the small projecting edge portion of the transfer disk approximately defines a narrow, peripherally extending portion of the disk, to transfer adhesive liquid to a corresponding line-like area on each wrapping sheet, parallel to the direction in which the sheet moves.

5. Apparatus according to claim 1 in which the transfer disk and the wiper disks are planar and parallel to one another.

6. Apparatus according to claim 1 in which said small, predetermined area is spaced up to approximately one millimeter from an edge of the sheet, and has dimensions up to approximately 3 millimeters.

* * * * *